US005819664A

United States Patent [19]

Steckler

[11] Patent Number: 5,819,664

[45] Date of Patent: Oct. 13, 1998

[54] PROCESS FOR CREATING TEXTURED IMAGES

[76] Inventor: Len Steckler, 1646 Woods Dr., Los Angeles, Calif. 90069

[21] Appl. No.: 713,813

[22] Filed: Sep. 13, 1996

[51] Int. Cl.[6] ..... B41C 33/00

[52] U.S. Cl. ..... 101/483; 101/34

[58] Field of Search ..... 101/483, 489, 101/211, 34

[56] References Cited

U.S. PATENT DOCUMENTS

| | | | |
|---|---|---|---|
| 3,748,202 | 7/1973 | Yoshiharu et al. | 101/211 |
| 3,924,066 | 12/1975 | Chapelle | 178/6.7 |
| 4,893,558 | 1/1990 | Gouch | 101/211 |
| 5,612,172 | 3/1997 | Wess et al. | 430/347 |

FOREIGN PATENT DOCUMENTS

| | | | |
|---|---|---|---|
| 0362182 | 4/1990 | European Pat. Off. | 101/483 |
| 57-109691 | 7/1982 | Japan | 101/211 |
| 62-174159 | 7/1987 | Japan | 101/211 |

*Primary Examiner*—Edgar S. Burr
*Assistant Examiner*—Anthony H. Nguyen
*Attorney, Agent, or Firm*—Fulbright & Jaworski LLP

[57] ABSTRACT

Multiple copies of an image including a textural base may be produced using a reproducible process. The process may include preparation of an image by scanning a pre-existing work and/or manipulating a digital representation of an image or electronically generating an image. The digital representation of the image may be created through a scanning process or through a illustrating or painting computer program such as Adobe Illustrator, Paintbrush or Correll Draw. The scanning may be advantageously performed using a Dicomed camera, flat-bed or film scanner or any other suitable method. The digital representation of the scanned or created image may be manipulated using image editing software such as Adobe PhotoShop. The image editor may also create a number of separations. The separations may include a four color image separation and a special relief separation. The special relief separation may include a representation of the Z axis of the image. Alternatively an image processing station may be programmed to interpret the digital representation in order to generate a special relief separation. Color intensity levels may be mapped into the relief separation. The relief separation may be fed to a printer capable of depositing a relief layer. The relief layer may be deposited by a printer having a robotic arm capable of Z axis displacement. After the relief layer is dried or cured an adhesion layer is applied by screening, spraying, washing, or other suitable process. An image, color or black and white, is printed on the relief layer over the adhesion layer. The process is reproducible due to the computer control.

8 Claims, 2 Drawing Sheets

PROCESS FOR CREATING TEXTURED IMAGES

BACKGROUND OF THE INVENTION

1. Field of the Invention

The invention relates to a process for creating textured images and, more particularly, to a printing process for depositing a textured relief structure on the surface of a substrate and printing on the relief texture.

2. Description of the Related Technology

Conventional printing processes are suitable to print flat images. Printing does not typically result in an image having any textured aspects or textural component. Painting surfaces using certain oil-based or substantial paints with sufficient body can result in an image having a textural component. The textural component adds to the aesthetics of an art work or image.

Previously, it has not been possible to reproduce in an automated or semi-automated fashion textural works in a fashion such that the reproduction also exhibits a textural component in the manner according to the invention.

SUMMARY OF THE INVENTION

It is an object of the invention to provide a process which will produce one or more copies of images which have a textural component.

It is a further object to the invention to allow reproduction of pictures to achieve a textural or three-dimensional feeling in a manner which gives new latitude to those creating and or reproducing the images.

It is a further object to provide a process which allows reproduction on any surface including steel, glass, ceramic tile, paper, canvas, etc. According to the invention, an image represented in a digital format may be reproduced with a textural component. The digital format specifies the textural component of the image as well as the visual or color component of the image. For example the digital representation may specify the image in any color space and may advantageously specify the appearance or characteristics of the image an X-Y coordinate based system and include information specifying a Z axis component. Alternatively the processing system according to the invention may interpret a two-dimensional representation to impose a textural aspect on the image. This may be done by using localized intensity levels to specify a relief or Z axis component of the image or translating the intensity to a relief separation.

The image may be obtained by a scanning process or advantageously using a Dicomed Digital Camera.

The first step in the process is to create a texture relief based on the digital representation of the image. The textured relief may be created by using a flat bed printer or a vertical printer to deposit an acrylic material on a paper in accordance with the textural component of the digital image. The acrylic material may be clear or pigmented. According to a preferred embodiment the acrylic material is clear or uniform in color and opaque. The acrylic relief layer is permitted to harden or cure. The hardening process may take approximately 1 hour. Advantageously, the acrylic material may be Novagel Semigloss or Semimatte Acrylic Gel.

The next step is to apply an adhesion or ink retaining layer to the relief structure. The acrylic material or other base material does not exhibit adequate adhesive characteristics to retain or hold an ink layer. The ink retaining or adhesion layer is provided to promote adhesion of inks to the relief layer. The retaining layer may be applied by any number of processes including silk screen printing, spray coating, a washing process or other suitable process. The ink retaining layer maybe a polyvinyl acetate copolymer emulsion similar to Polyco 2186 manufactured by Borden Chemical Division. Advantageously the emulsion is made up of the following components:

| Component | Amount Present (% w/w) |
|---|---|
| A. Water | 76.49 |
| B. Resin Amount | 13.88 |
| Resin Type - Polyvinyl acetate copolymer emulsion | |
| C. Pigment/Filler Type | |
| 1. Calcium Carbonate | 0.8 |
| 2. Kaolin (clay) | 1.9 |
| 3. Aluminum Oxide | 2.4 |
| 4. Iron Oxide | 0.9 |
| 5. Titanium Dioxide | 0.3 |
| TOTAL | 6.3 |
| D. Surfactants | 1.60 |
| E. Thickeners | 1.73 |
| TOTAL | 100.0 |

After application of the ink retaining layer the next step is to print the X-Y component of the image. This may be done by conventional color printing process and may be accomplished with the use of the afore-referenced flat bed or vertical printer or advantageously with an Iris brand printer available from Scitex Corporation. The coated relief surface may be printed using other techniques also.

DETAILED DESCRIPTION OF THE PREFERRED EMBODIMENT

Figure 1:
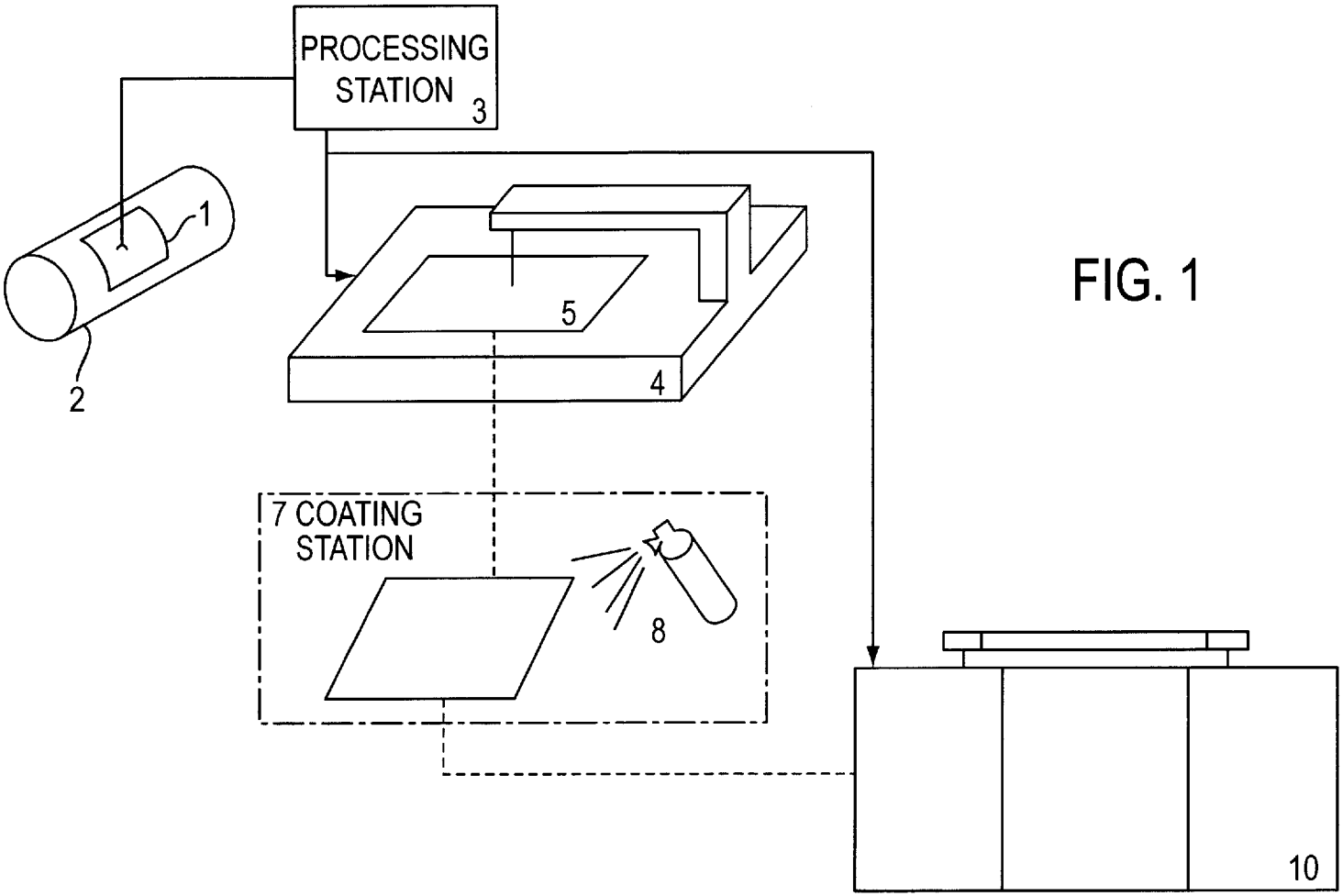
FIG. 1 shows a schematic illustration of a method according to the invention.
Figure 2:
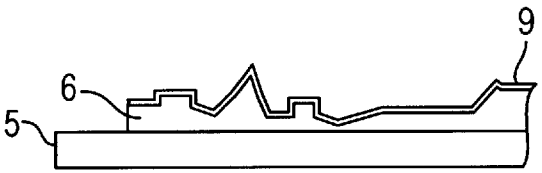
FIG. 2 schematically illustrates a textural reproduction according to the invention.

FIG. 1 schematically illustrates the method according to the invention using graphical representations of the equipment. The process may be initiated by scanning an image or artwork 1 which may have a textural component. The scanner 2 is illustrated as a drum scanner. In practice many of the images scanned will be substantially plainer and it will be more appropriate to use a flat-bed scanner or advantageously a Dicomed camera. The schematic illustration of a drum is intended to represent any type of apparatus for capturing a digital representation of an image.

The image may be fed into a processing station 3 which may advantageously be a Power Macintosh computer with suitable software, peripherals and drivers. Alternatively the processing station may be any other suitable computer.

The processing station may include an image editing system such as Adobe PhotoShop. If the scanned image does not include a textural component or the scanner is not capable of receiving textural components an operator of the processing system may use a suitable image editing tool such as PhotoShop to add a textural component to the digital representation obtained from the scanner. The textural component is then transferred to a printer 4. The printer may advantageously be a suitable flat-bed or vertical printer and advantageously includes a robotic arm which operates in the Z axis in addition to the X and Y axis or has some other provision for applying material in varying depths to a substrate 5.

The driver software for the printer 4 may reside in the printer or in the processing station.

The substrate 5 may be any of a broad range of materials. Advantageously the substrate may be some type of paper whether it is machine manufactured or hand made. For many applications hand made paper is preferable. In addition the substrate may be other structural bodies such as wood, metal, glass, ceramic.

The relief structure 6 may be an acrylic material deposited on the substrate. The substrate may then be transferred to a coating station 7 for the application of an ink retaining or adhesion material 8, applied as a thin adhesion layer 9 to the relief layer 6.

The coating station may include any suitable process for the application of the adhesion layer. The function of the adhesion layer is to permit ink to properly adhere to the relief structure 6. Coating may be accomplished by any of a variety of processes including spraying, washing, silk-screen printing, or other depositing process.

The substrate is then transferred to a printer 10. The printer may be any printer suitable to print on the substrate. According to one preferred embodiment the printer may be a Iris brand printer, available commercially from Scitex Corporation. Alternatively the substrate may be printed on a flat-bed or vertical printer.

The X-Y or image component of the digital representation is then used to drive the printer 10 to deposit the appropriate color pigments on the adhesion layer of the substrate. Color pigment may advantageously be deposited in accordance with the image present on the original work 1.

According to the invention multiple reproductions of an original or multiple copies of the same image may be prepared using this process.

Those of skill in the art will be able to select materials for use as the relief layer and the adhesion layer. The relief layer may advantageously be an acrylic material suitable for use in connection with a liquid jet printer. The adhesion layer may be a material which is sufficient to adhere to the selected relief layer material and exhibits a suitable level of adhesion for the inks used in the image printer 10.

I claim:

1. A method for producing an image exhibiting a textural component comprising the steps of:

application of a relief layer corresponding to said textural component of said image to a substrate;

application of an adhesion layer to the relief layer; and printing onto said adhesion layer.

2. A method according to claim 1 wherein the step of application of a relief layer further comprises using a digitally driven printer to apply a relief structure.

3. A method according to claim 2 wherein the step of application of the relief structure further comprises application of an acrylic material.

4. A method according to claim 1 wherein the step of application of an adhesion layer further comprises screen printing the adhesion layer.

5. A method according to claim 4 wherein the step of application of the adhesion layer further comprises applying the adhesion layer by an automated mechanical process.

6. A method according to claim 1 wherein the step of printing comprises printing an X-Y component of said image using a computer driven printing system.

7. A method according to claim 6 wherein the step of printing comprises printing an image with a color printer.

8. A method according to claim 7 wherein the step of printing further comprises printing an image with a four color printer.

* * * * *